US012510315B2

(12) United States Patent
Weilharter

(10) Patent No.: US 12,510,315 B2
(45) Date of Patent: Dec. 30, 2025

(54) FIREARM

(71) Applicant: Rene Weilharter, Marbach (AT)

(72) Inventor: Rene Weilharter, Marbach (AT)

( * ) Notice: Subject to any disclaimer, the term of this patent is extended or adjusted under 35 U.S.C. 154(b) by 92 days.

(21) Appl. No.: 18/572,525

(22) PCT Filed: Jun. 30, 2022

(86) PCT No.: PCT/AT2022/060232
§ 371 (c)(1),
(2) Date: Dec. 20, 2023

(87) PCT Pub. No.: WO2023/283664
PCT Pub. Date: Jan. 19, 2023

(65) Prior Publication Data

US 2024/0288236 A1 Aug. 29, 2024

(30) Foreign Application Priority Data

Jul. 12, 2021 (AT) ..... A 50572/2021

(51) Int. Cl.

| | |
|---|---|
| ***F41A 3/62*** | (2006.01) |
| ***F41A 3/36*** | (2006.01) |
| ***F41A 3/66*** | (2006.01) |
| ***F41A 5/26*** | (2006.01) |
| *F41A 5/30* | (2006.01) |

(52) U.S. Cl.
CPC ..... *F41A 3/62* (2013.01); *F41A 3/36* (2013.01); *F41A 3/66* (2013.01); *F41A 5/30* (2013.01)

(58) Field of Classification Search
CPC ..... F41A 5/26; F41A 3/62
See application file for complete search history.

(56) References Cited

U.S. PATENT DOCUMENTS 929,286 A * 7/1909 Clarus ..... F41A 19/30 89/144
1,834,021 A * 12/1931 Destree ..... F41A 3/62 89/193

(Continued)

*Primary Examiner* — Derrick R Morgan
(74) *Attorney, Agent, or Firm* — Andrew Wilford

(57) ABSTRACT

The invention relates to a firearm comprising: a housing (1) having a receptacle (2) for several cartridges or for a magazine with cartridges; a barrel unit (3) which is located in the housing (1) and has a barrel (4) and a cartridge chamber (6); a breechblock (8), which can be moved relative to the housing (1) and is biased in the firing direction by means of a return spring (7), for conveying cartridges into the cartridge chamber (6) or cartridge cases to an ejection port; and a gas braking device which is located in the housing (1) and comprises a cylinder (9) which is positioned parallel to the barrel (4) and which is connected to the interior of the barrel (4) via a gas extraction opening (10); and a piston (11) which can be moved inside the cylinder (9) and which is coupled to the breechblock (8). The breechblock (8) is located in a breechblock carrier unit (12) which is located completely inside the housing (1) over the entire movement path while a shot is being fired and during a reloading operation, the breechblock carrier unit (12) comprising the breechblock (8) itself, two connecting sections (13) guided parallel to the barrel (8) in the housing (1), and a coupling section (14) to be coupled with the piston (11) of the gas braking device.

5 Claims, 2 Drawing Sheets

(56) References Cited

U.S. PATENT DOCUMENTS 2,582,989 A * 1/1952 Harvey ..... F41A 5/26 89/193
2,865,256 A * 12/1958 Marsh ..... F41A 3/62 89/191.01
2,887,013 A * 5/1959 Marsh ..... F41A 21/28 89/193
3,580,132 A * 5/1971 Vartanian ..... F41A 5/18 42/1.06
3,990,346 A * 11/1976 Irwin ..... F41A 3/62 89/191.01
4,127,056 A * 11/1978 Kart ..... F41A 21/488 89/196
4,580,484 A * 4/1986 Moore ..... F41A 5/18 89/187.02
4,977,815 A * 12/1990 Stephens ..... F41A 21/28 89/14.3
5,388,500 A * 2/1995 Petrovich ..... F41A 3/62 89/129.01
5,688,500 A 11/1997 Barclay
6,622,610 B2 * 9/2003 Adkins ..... F41A 3/62 89/193
8,065,949 B1 * 11/2011 Molinari ..... F41A 5/28 89/193
9,377,257 B2 * 6/2016 Foster ..... F41A 3/72
10,203,173 B2 * 2/2019 Ellis ..... F41A 5/02
10,895,423 B2 1/2021 Weilharter
11,204,209 B2 * 12/2021 Craig ..... F41A 3/54
11,536,522 B2 * 12/2022 Puha ..... F41C 23/06
2002/0096042 A1 * 7/2002 Adkins ..... F41A 3/62 89/194
2015/0276334 A1 10/2015 Pflaumer
2018/0347926 A1 * 12/2018 Lopatin ..... F41A 5/24
2020/0200495 A1 * 6/2020 Weilharter ..... F41A 5/12
2021/0116190 A1 * 4/2021 Craig ..... F41A 3/54
2021/0372721 A1 * 12/2021 Zukowski ..... F41A 5/24
2022/0136787 A1 * 5/2022 Caudle ..... F41A 3/86 89/191.01
2022/0333884 A1 * 10/2022 Kennedy ..... F41A 5/26
2024/0230259 A1 * 7/2024 Perle ..... F41A 3/90

* cited by examiner

Fig. 1
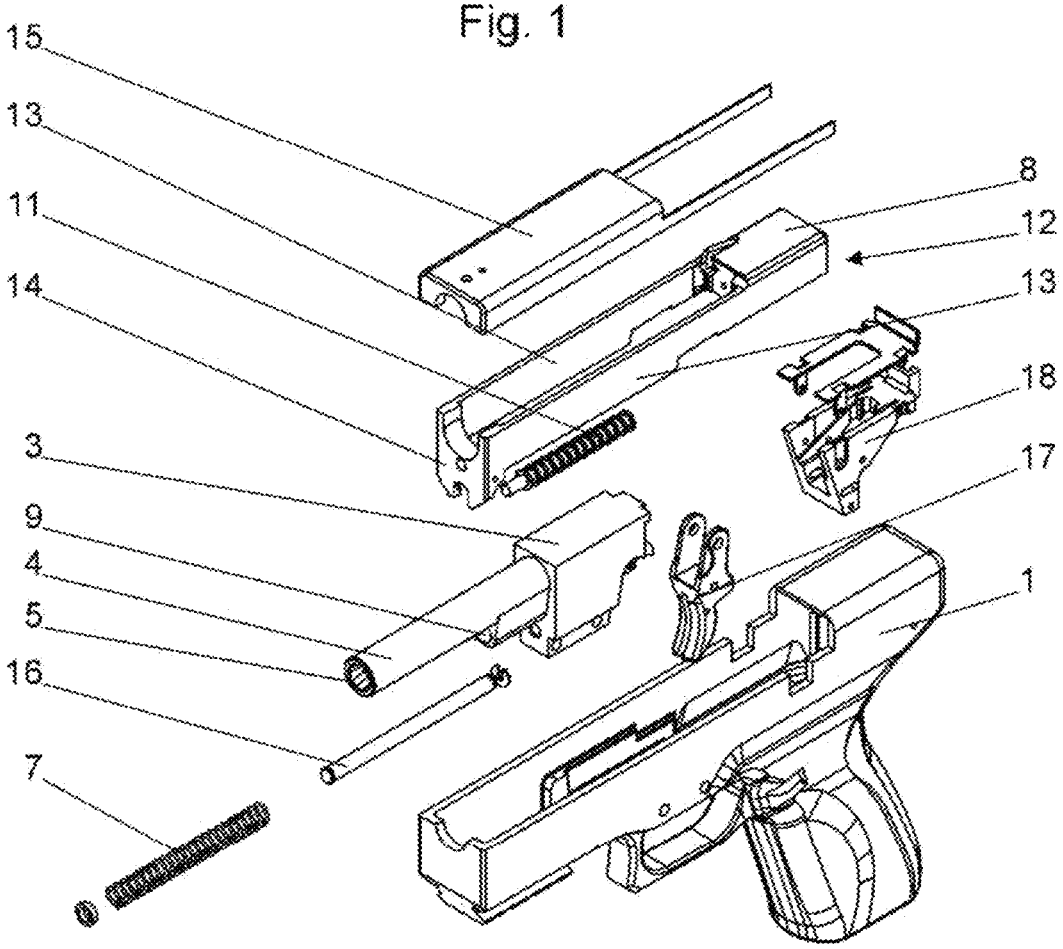
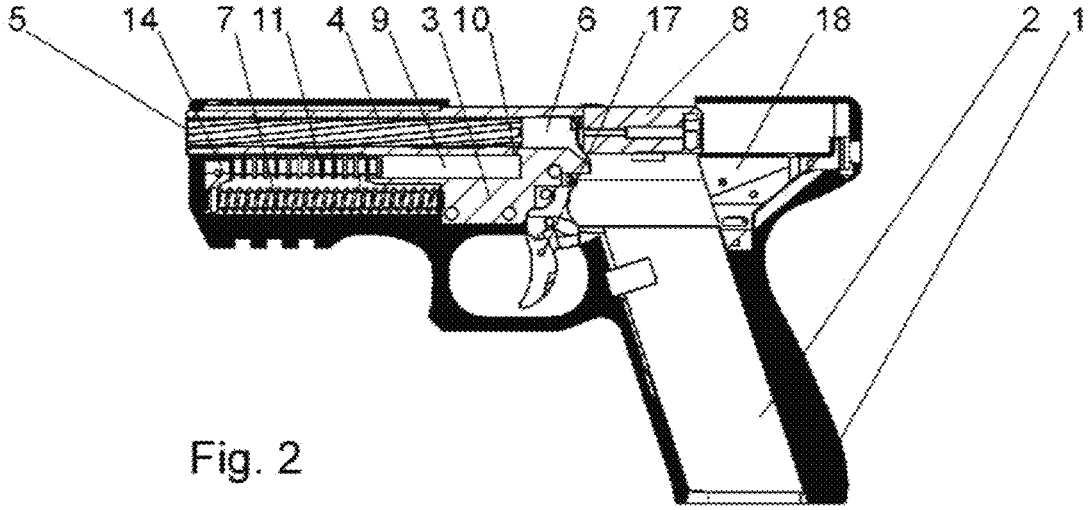
Fig. 2

FIREARM

CROSS REFERENCE TO RELATED APPLICATIONS

This application is the US-national stage of PCT application PCT/AT2022/060232 filed 30 Jun. 2022 and claiming the priority of Austrian patent application AT50572/2021 itself filed 12 Jul. 2021.

FIELD OF THE INVENTION

The invention relates to a firearm comprising a receiver with a chamber for several cartridges or for a magazine with cartridges. Such a firearm typically has a barrel subassembly in the receiver and having a barrel with a front muzzle and a breech at the opposite rear end, a slide movable relative to the receiver longitudinally of the barrel and biased forward in the firing direction by a recoil spring for conveying cartridges from the chamber or from the magazine into the bolt or for conveying cartridge cases to an ejection port, and a gas brake in the receiver and comprising a cylinder arranged parallel to the barrel and connected to the interior of the barrel via a gas port, and a piston movable within the cylinder and coupled to the bolt.

STATE OF THE ART

It is known that semiautomatic firearms with a blowback action can often only fire smaller calibers, as the locking mechanism based solely on the inertia of the bolt action no longer closes properly if the propellant charge is too large. In order to be able to fire larger caliber ammunition, the bolt mass can be increased or the force of the recoil spring can be increased. However, a larger bolt mass means a higher recoil and a corresponding jump of the weapon when firing, which in turn leads to greater inaccuracy. A recoil spring that is too strong makes it difficult for the user to load the gun manually, which is why this option is also quite limited.

Various dampers and delay systems are known in the prior art in order to achieve delayed bolt opening. For example, US 2002/0096042 [U.S. Pat. No. 10,895,423], US 2015/0276334, or US 2021/0116190 discloses firearms with a gas brake that either dampens the backward movement of the bolt or delays the opening of the bolt when a shot is fired.

A further problem with all weapons currently on the market with a blowback action is that the mass is guided on the outside of the weapon, usually on the top of the receiver, due to its necessary size and also due to the standard design as a slide in the state of the art. This means that, each time a shot is fired, the slide disengages completely, exposing the parts of the firearm inside the receiver directly to the environment. Depending on where the firearm is used, dust and dirt can very easily get into the firearm and impair its continued functionality.

AT 519743 [U.S. Pat. No. 10,895,423] was the first time that a firearm with a delayed bolt action was proposed, in which the entire moving firing mechanism is guided completely inside the receiver over the entire movement path. In order to also enable a mechanism with a fixed barrel, two springs with different spring constants as well as a multipart construction of the bolt, the locking block and a follower bracket are necessary. The firearm described therefore has the advantage of being particularly light, as only a small mass is required. A further advantage is that the entire locking mechanism is housed inside the receiver and thus protected from environmental influences. This increases the functional reliability of the gun. However, there is still room for improvement with regard to the design and number of parts required as well as their movement during firing.

OBJECT OF THE INVENTION

The object of the present invention is therefore to further improve the weapon described in AT 519743 so that a firearm is created that is even simpler in construction and has even greater functional reliability. The weight of the weapon is to be kept low and the entire locking mechanism must be inside the protective receiver. The number of parts is to be reduced, which will also cut manufacturing costs. Furthermore, all movement sequences of the bolt mechanism during firing and reloading should be as linear as possible.

SUMMARY OF THE INVENTION

This object is attained according to the invention in that the bolt is in a slide located completely inside the receiver over the entire movement path during the firing and reloading process, the slide comprising the bolt itself, two webs guided parallel to the barrel in the receiver and a coupling section for coupling with the piston of the gas brake. By integrating the gas brake, the design of the firearm can be significantly simplified. All moving components, such as the slide and the piston, are guided linearly and move completely within the receiver. The gas brake system also allows the bolt/slide to be very small and light, which has a positive effect on the overall weight of the firearm. The gas brake also offers the advantage that larger calibers with more powerful propellants can be used. The resistance of the gas brake is always set automatically based on the propellant charge present so that the bolt is kept closed until the cartridge has left the barrel.

It is a preferred feature that the slide/bolt is a single piece. In order to keep the production costs and also the design as simple as possible, it is advantageous if the slide is manufactured as a one-piece component. This also offers advantages for the user when dismantling and cleaning the weapon.

According to a further preferred feature, it is provided that the gas port is in the barrel near its rear end of the bolt side. This arrangement allows gas to be fed from the propellant charge into the cylinder immediately after the shot is fired. Gas pressure is therefore built up both rearward toward the bolt and forward toward the piston in the cylinder, which means that the effect of the gas brake is always constant regardless of the strength of the propellant charge. Pressure and counter-pressure balance each other evenly at every possible gas pressure until the cartridge has left the barrel and the bolt can perform its backward movement.

It is also a preferred feature that a cover is provided that is displaceable relative to the receiver longitudinally of the barrel and that is biased toward its closed position by a spring, the cover having a driver section that projects inward into the receiver and that can be coupled to the slide for manually reloading when the cover is moved against the firing direction, but is decoupled from the slide when the cover is in its closed position. This cover closes the receiver above the barrel. During firing and the automatic reloading process, the cover remains closed at all times, preventing dust or dirt from entering the interior of the receiver. The cover can also be used for manual reloading of the firearm via a longitudinal guide and a carrier section, in that the carrier section carries the slide to the rear when the user pulls it back manually. The driver section can, for example, be an inwardly projecting projection that can be brought into contact with a corresponding stop surface of the slide. Since the cover here also does not correspond to the classic slide, which usually forms the majority of the bolt mass, the cover can be manufactured correspondingly light, which also has a positive effect on the overall weight of the firearm.

According to one possible embodiment, it is provided that the recoil spring extends parallel to the barrel and is supported on the one hand on a stationary part of the receiver and on the other hand on the slide/bolt unit. This represents a particularly simple way of mounting the recoil spring required to urge the slide toward the closed position and to move the slide forward again from the rear disengaged position during the reloading process.

According to an alternative embodiment, it is provided that the recoil spring extends parallel to a guide rod arranged parallel to the barrel and connected to an immovable part within the receiver and is supported on the one hand on an immovable part within the receiver and on the other hand on the slide. Depending on the design of the weapon, the recoil spring can also be guided on a corresponding guide rod, for example below the barrel and below the cylinder. In addition to the recoil spring, a spring is also required to reload the cover. For example, the spring for the cover can be arranged on a guide rod and the recoil spring around the barrel or vice versa. Depending on the design and the space available inside the gun, the two springs required can also be positioned elsewhere.

BRIEF DESCRIPTION OF THE DRAWINGS

The invention will now be described in greater detail with reference to an embodiment and with the aid of the accompanying figures. Therein:

FIG. 1 is a schematic exploded view of the essential elements of a firearm according to the inventive handgun, FIG. 2 is a schematic longitudinal section through the inventive handgun with a closed bolt.

WAY(S) TO CARRY OUT THE INVENTION

Figure 3:
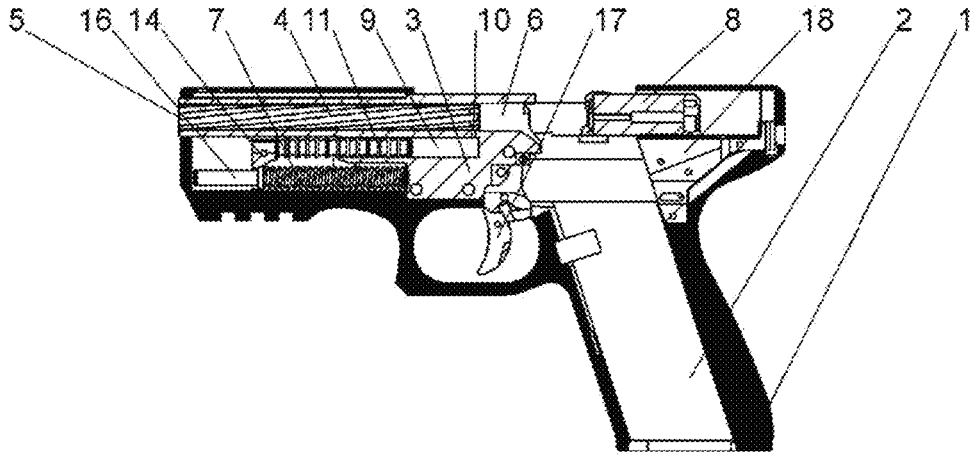
FIG. 3 is a schematic longitudinal section through the firearm according to FIG. 2 shortly after firing in an intermediate position with the bolt already partially moved to the rear.

The firearm according to the invention, shown schematically in an exploded view in FIG. 1, has a receiver 1 with a chamber 2 (see FIG. 2) for a magazine. A trigger 17, a hammer 18 as well as a barrel subassembly 3 and a slide 12 are in the receiver and the top of the receiver 1 is closed by a cover 15 movable longitudinally. The barrel subassembly 3 comprises a barrel 4 with a muzzle 5 at the front and a breech hole 6 at the rear (see FIG. 2). Furthermore, in the example shown, the barrel subassembly 3 holds a cylinder 9 of a gas brake and a guide rod 16 for a recoil spring 7. The slide 12 comprises the actual bolt 8 and a coupling section 14 rigidly connected to it via two connecting web 13 to which a piston 11 of the gas brake is fixed.

Figure 4:
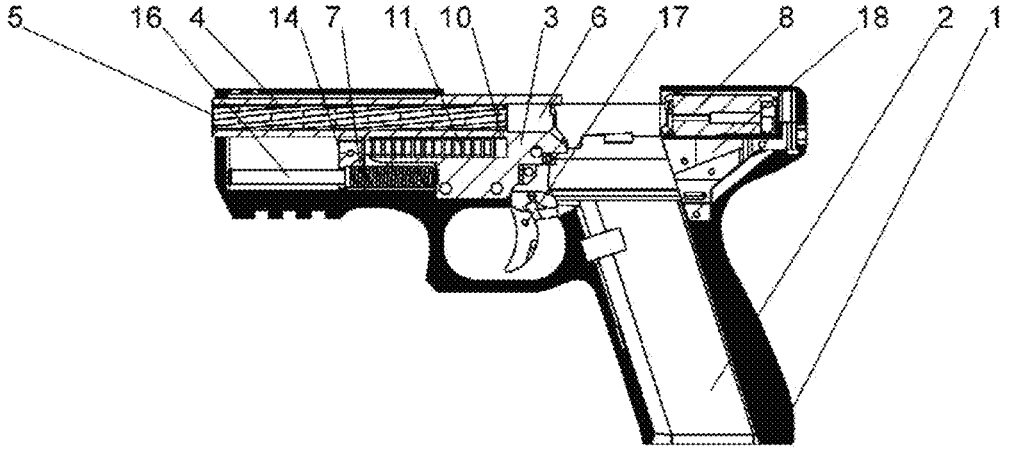
FIG. 4 is a schematic longitudinal section through the firearm according to FIG. 2 with the slide moved fully to the rearar.

FIGS. 2 to 4 show the individual positions of the slide 12 before firing and during the reloading process in a schematic longitudinal sectional view.

FIG. 2 shows the situation before a shot is fired. A cartridge and a magazine filled with cartridges in the receiver 2 are not shown. Before firing, the slide 12 is in a front bolt-closed position. The bolt 8 is biased in the firing direction against the breech 6 via the recoil spring 7, which engages with the coupling section 14 of the slide 12.

As soon as a shot is fired by actuating the trigger 8, the bullet moves from the bolt 6 into the barrel 4. The gas port 10 is directly adjacent the bolt 6 and connects the inside of the barrel 4 with the cylinder 9 of the gas brake. Immediately after the shot is fired, the gas pressure builds up on the one hand in the direction against the firing direction at the bolt and on the other hand gas flows into the cylinder 9 via the gas port 10, whereby the gas pressure also acts in the firing direction on the piston 11 that thus also acts on the bolt 8 via the coupling section 14 to keep it closed. Regardless of the level of the actual gas pressure, the pressure in the cylinder 9 and in the barrel 4 balance each other out so that the bolt 8 remains closed until the bullet leaves the barrel.

After the bullet leaves the barrel, the gas pressure suddenly drops and the bolt can open and start moving rearward. An intermediate position with half-open bolt 8 is shown in FIG. 3. The coupling section 14 rigidly connected to the bolt 8 via the webs 13 also moves rearward and compresses the recoil spring 7.

FIG. 4 finally shows the rear disengaged position of the slide 12. Here, the spent cartridge case has already been ejected and the recoil spring 7 begins to move the slide 12 back to the front position, and a further cartridge is conveyed from the magazine into the bolt 6, after which the position shown in FIG. 2 is reached again.

Figure 5:
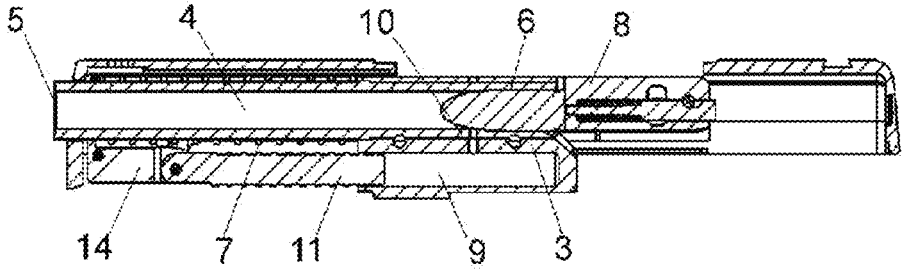
FIG. 5 is a sectional view of a detail of an alternative embodiment of the invention.

FIG. 5 shows the upper part of an automatic pistol like that of FIGS. 1-4 but with the recoil spring 7 surrounding the barrel 4.

The invention claimed is:

1. A firearm comprising: a receiver with a chamber for a plurality of cartridges or for a cartridge-holding magazine, a longitudinally extending barrel in the receiver and having a muzzle at a longitudinal front end of the barrel and a breech at an opposite rear end of the barrel, a bolt movable longitudinally of the barrel relative to the receiver, a recoil spring biasing the bolt longitudinally for conveying cartridges from the chamber or from the magazine into the breech or for conveying cartridge cases to an ejection port, a gas brake in the receiver and including a cylinder extending parallel to the barrel and connected to the interior of the barrel via a gas port and a piston movable within the cylinder and coupled to the bolt, a slide completely formed with the bolt and inside the receiver over the entire path of longitudinal movement of the slide during firing and reloading, the slide having two webs extending parallel to the barrel in the receiver and a coupling section for coupling to the piston of the gas brake, a cover displaceable relative to the receiver longitudinally of the barrel, and a cover spring biasing the cover toward a closed position, the cover having a driver section projecting inward into the receiver and couplable to the slide for manual reloading when the cover is moved longitudinally rearward but decoupled from the slide when the cover is in a closed position.

2. The firearm according to claim 1, wherein the slide is formed in one piece with the webs and coupling section.

3. The firearm according to claim 1, wherein the gas port is in the barrel near a rear end of the bolt.

4. The firearm according to claim 1, wherein the recoil spring surrounds the barrel and is supported between a nonmoving part inside the receiver and the slide.

5. The firearm according to claim 1, wherein the recoil spring surrounds a guide rod extending longitudinally parallel to the barrel and is connected to an immovable part of the receiver and is braced between an immovable part inside the receiver and the slide.

* * * * *